US009185502B2

(12) United States Patent
Johansson

(10) Patent No.: US 9,185,502 B2
(45) Date of Patent: Nov. 10, 2015

(54) ACOUSTICAL TRANSMISSION MEANS AND METHOD FOR TRANSMITTING SOUND

(71) Applicant: Oticon Medical A/S, Smørum (DK)

(72) Inventor: Tomas Johansson, Smørum (DK)

(73) Assignee: OTICON MEDICAL A/S, Smorum (DK)

( * ) Notice: Subject to any disclaimer, the term of this patent is extended or adjusted under 35 U.S.C. 154(b) by 242 days.

(21) Appl. No.: 13/785,269

(22) Filed: Mar. 5, 2013

(65) Prior Publication Data

US 2013/0245363 A1 Sep. 19, 2013

(30) Foreign Application Priority Data

Mar. 7, 2012 (EP) ..... 12158397

(51) Int. Cl.
*H04R 25/00* (2006.01)

(52) U.S. Cl.
CPC ..... *H04R 25/65* (2013.01); *H04R 25/606* (2013.01); *H04R 2225/67* (2013.01); *H04R 2460/13* (2013.01)

(58) Field of Classification Search
CPC ..... H04R 25/65; H04R 2460/13; H04R 2225/67; H04R 25/606
USPC ..... 600/25; 128/897–899; 607/57
See application file for complete search history.

(56) References Cited

U.S. PATENT DOCUMENTS

| | | | | |
|---|---|---|---|---|
| 4,352,960 | A | 10/1982 | Dormer et al. | |
| 5,176,620 | A * | 1/1993 | Gilman | 600/25 |
| 5,318,502 | A * | 6/1994 | Gilman | 600/25 |
| 6,099,462 | A * | 8/2000 | aWengen | 600/25 |
| 6,259,951 | B1 | 7/2001 | Kuzma et al. | |
| 6,402,682 | B1 * | 6/2002 | Johansson | 600/25 |
| 6,726,618 | B2 | 4/2004 | Miller | |
| 7,974,700 | B1 * | 7/2011 | Gibson | 607/55 |
| 2007/0053536 | A1 * | 3/2007 | Westerkull | 381/326 |
| 2008/0064918 | A1 * | 3/2008 | Jolly | 600/25 |
| 2009/0287038 | A1 | 11/2009 | Parker | |
| 2009/0306744 | A1 | 12/2009 | Parker et al. | |

FOREIGN PATENT DOCUMENTS

| | | | |
|---|---|---|---|
| DE | 100 30 372 | A1 | 1/2002 |
| EP | 0 936 840 | A1 | 8/1999 |
| WO | WO 98/47316 | A1 | 10/1998 |
| WO | WO 2007/024657 | A2 | 3/2007 |
| WO | WO 2008/011359 | A1 | 1/2008 |

* cited by examiner

*Primary Examiner* — Christine H Matthews
*Assistant Examiner* — Sunita Reddy
(74) *Attorney, Agent, or Firm* — Birch, Stewart, Kolasch & Birch, LLP

(57) ABSTRACT

An acoustic transmission device for transmission of acoustical energy to the cochlea includes a liquid conducting assembly, an acoustic input unit, and a vibration transducer abutting a transmission area on an outer surface of the skin over a transition area of the acoustic input unit. The assembly includes a tube with a liquid or semi-liquid medium filling the bore of the tube, and is adapted to be terminated in direct operative association with the cochlea. The acoustic input unit is adapted to be disposed subcutaneously between a skull bone surface and an external skin surface. The vibration transducer is adapted to be magnetically attachable at a fastening area adjacent to the transmission area by a magnetic assembly configured to be provided under the skin in the fastening area around the transition area.

12 Claims, 13 Drawing Sheets

ACOUSTICAL TRANSMISSION MEANS AND METHOD FOR TRANSMITTING SOUND

TECHNICAL FIELD

The application relates to an acoustic transmission means and a listening device. The disclosure relates specifically to an acoustical transmission means for transmission of acoustical energy to the cochlea comprising liquid conduction means comprising a tube defining a bore therethrough and a liquid or semi-liquid filling said bore, for conducting acoustical energy there along; and terminating said liquid conduction means in direct operative association with a window or aperture in the cochlea, for introducing said acoustical energy there through and acoustic input means at said liquid conduction means.

The disclosure may e.g. be useful in applications such as hearing aids, headsets, ear phones, handsfree telephone systems, mobile telephones etc.

BACKGROUND

It is known to provide vibrations to the skull bone directly or indirectly in order to excite the cochlea whereby this excitation may be perceived as sound. This is done to provide some kind of hearing to people who has a functioning cochlea, but have damaged or deformed ear structures.

It is known to mechanically press a vibrating transducer towards the skin in order to transmit the vibration signal through the skin and into the bone, in order that the signals may reach the cochlea and be perceived as sound. In these instruments the transducer is pressed towards the skin using a spring or headband.

It is known to provide hearing to these patients by attaching a magnetic means to the skull bone surface under the skin, and then excite the magnetic means with a magnetic field corresponding to a sound signal. Also a magnet provided subcutaneous may serve as an attachment point for a conventional vibrator which will be sitting exteriorly on the skin, attached thereto by the subcutaneous magnet. In both these instances, the skin between magnet and the exterior part may be subject to compression forces, and this may hamper blood circulation in this skin layer and serious negative effects such as irritation and necrosis may result from this.

Yet a further prior art example is to attach a vibrational transducer subcutaneously to the skull bone or cochlea and to energize the transducer by means of an electromagnetic signal provided by an externally mounted apparatus. In this kind of apparatus, a transcutaneous transmission of both energy and signal is necessary from the device on the outside to the transducer placed at the cochlea or under the skin, and a coil or similar device is needed to receive powering energy as well as an information signal.

In a prior art device the transducer is provided under the skin behind the ear, and an acoustic wave guide is provided between the transducer and the cochlea. In this way, the skull bone is not used as transmission path, and the transducer may be made smaller and may consume less energy in order to vibrationally excite the cochlea. However, in this prior art device the power signal is still to be transmitted through the skin as an electromagnetic signal, with associated losses, and a complicated transducer with a multitude of electronic components must be provided in or at the skull bone.

SUMMARY

An acoustical transmission means is provided for transmission of acoustical energy to the cochlea comprising: liquid conduction means comprising a tube defining a bore therethrough and a liquid or semi-liquid medium filling said bore, for conducting acoustical energy there along and terminating said liquid conduction means in direct operative association with the cochlea, for introducing said acoustical energy to the cochlea, acoustic input means at said liquid conduction means, wherein said acoustic input means are adapted to be disposed subcutaneously between the skull bone surface and an external skin surface and comprise a transition area which at a first side thereof abuts an underside of the skin and at a second side thereof abuts the liquid or semi-liquid medium.

With this acoustic transmission means an alternative audio transmission channel between a skin surface located above a skull bone part and to a suitable structure of the cochlea is provided. Situating the acoustic input means below the skin surface and above the skull bone surface allows vibrations to be transmitted from a transducer mounted externally. Such vibrations may travel from the transducer and into the skin, through the transition area and into the fluid or semi-fluid filled tube. Once in the tube the vibrations may travel towards the cochlea without dissipation due to large impedance mismatch between the fluid or semi-fluid material and the tube inner wall material. Mounting of the transducer exteriorly has several advantages: it allows the transducer to be easily replaced, it ensures that the implanted part is small and uncomplicated and the need for transcutaneous transmission of electromagnetic signals is eliminated. A more energy efficient and dependable system will be possible with this acoustic transmission means.

Objects of the application are achieved by the invention described in the accompanying claims and as described in the following.

The acoustic transmission means may be adapted to receive vibrations from a vibration generating transducer which abuts a transmission area on an outer surface of the skin over the transition area, and the transducer may in this case be magnetically attachable at a fastening area, said area being adjacent to the transmission area. This arrangement of the attachment and transmission area allows the attachment area to be more widespread and possibly dispersed which would not be possible in prior art systems, where attachment area and transmission area typically co-inside.

This listening device may be magnetically attached to an acoustic transmission means of the above kind and thereby form a hearing aid which has certain advantages over prior art hearing aids of the kind used to transmit vibrations directly to the cochlea, by-passing the usual route of transmission through the tympanic membrane and the inner ear ossicles. The magnetic forces needed to keep the listening device in place above the membrane are not very strong as the transmission path to the cochlea is basically without loss, rendering the demands on the vibrator small, so that a light weight instrument may be utilized. Also high pressure between the vibrating surface of the transducer and the skin is not needed in order to transmit vibrations into the acoustical transmission means, and magnetic surplus force is not needed to ensure such a high pressure. According to the invention a reduced pressure is provided, which is dimensioned to ensure that during operation the vibrating contact part of the transducer does not loose contact with the skin surface during vibration.

A method is also provided for transmitting a sound signal to the cochlea. According to the method a sound signal is captured by a microphone, and transmitted as an electrical audio signal to a signal processing device, the audio signal is processed in the signal processing device and a resulting enhanced electrical signal is served at a transducer, said transducer being adapted to transmit a vibrational sound signal to an outer skin surface based on the enhanced electrical signal, transmitting said vibrational signal through the skin and through a subcutaneous membrane and into a fluid conduct, transmitting said vibrational signal through said fluid conduct to the cochlea, and transmitting said sound signal into the cochlea.

It is intended that the structural features of the device described above, in the 'detailed description of embodiments and in the claims can be combined with the method, when appropriately substituted by a corresponding process and vice versa. Embodiments of the method have the same advantages as the corresponding devices.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. Specifically the term "microphone" may cover an array or microphones or any known arrangements of microphones. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference numerals are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

Figure 1:
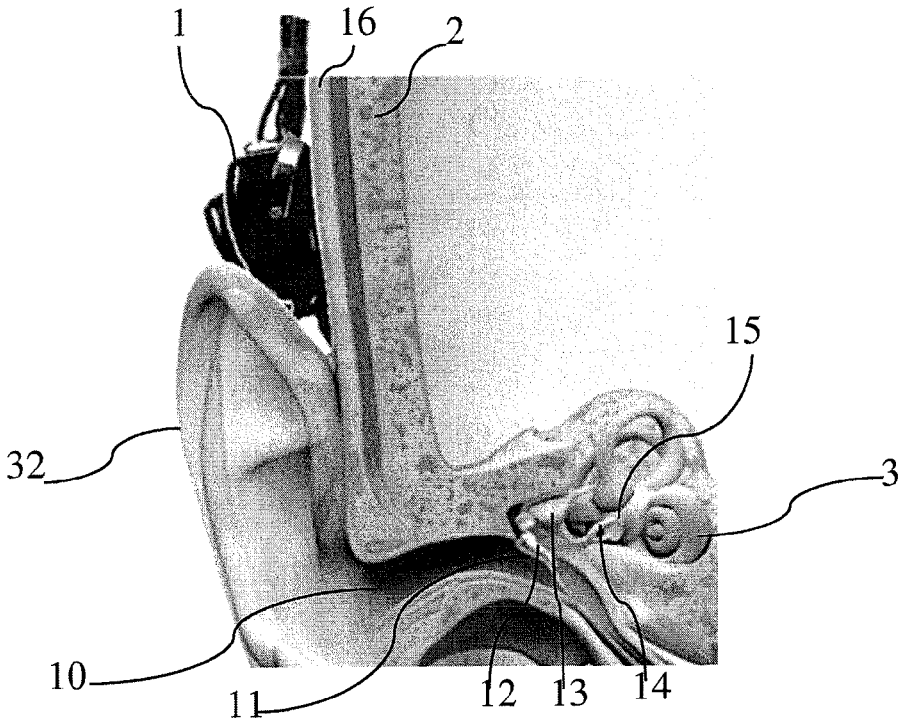
Fig. 1 PRIOR ART
FIG. 1 shows a schematic sectional view through an ear with a prior art bone conduction hearing aid attached to a spring.

FIG. 1 discloses a prior art vibrator 1 which is used to vibrationally excite the skull bone 2, such that the skull bone vibrations will travel through the bone tissue and reach the cochlea 3, causing the cochlea 3 to vibrate accordingly. This vibration is perceived by the cochlea 3 as sound. In this manner, the usual sound input path to the cochlea going through the ear canal 10, the tympanic membrane 11, via the middle ear ossicles 12, 13, 14 to finally reach the inner ear cochlea 3 through the oval window 15, is bypassed. The vibrator 1 is pressed against the skin 16 by means of a spring or headband or similar element. The transmission of the vibrations through the skin 16 will result in some dampening, and also a considerable pressure between the vibrator and the skin 16 is required in order to ensure that the vibrations are transmitted to the skull bone 2. This pressure may lead to headaches, skin irritation and bone decomposition at the pressurized area.

Figure 2:
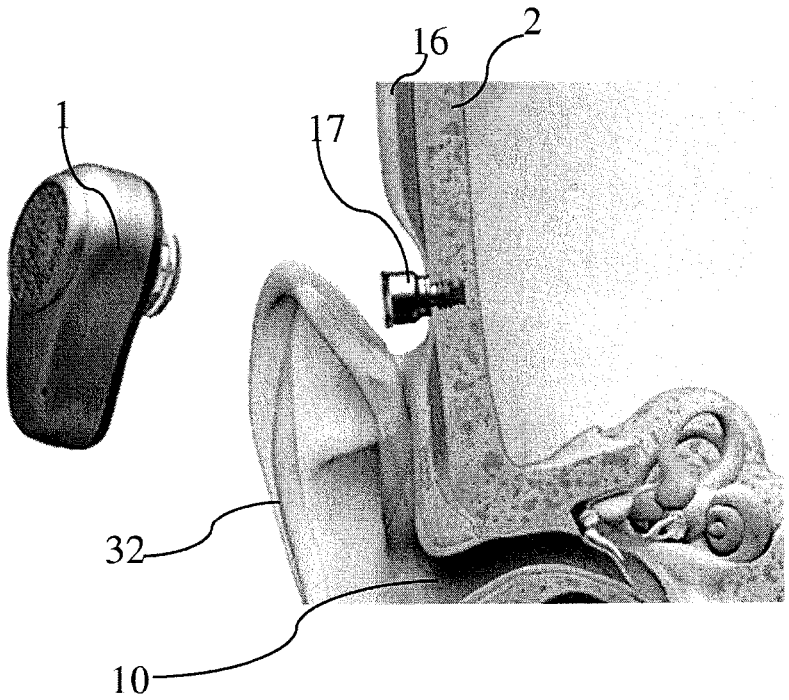
Fig. 2 PRIOR ART
FIG. 2 shows a sectional view through an ear with a bone anchored abutment behind the ear and a prior art vibrator adapted for attachment to the abutment.

In FIG. 2 an improved prior art hearing device is shown, where the vibrator 1 is to be coupled to a bone integrated anchor 17, which protrudes through the skin 16. This allows for nearly loss free transmittance of vibrations to the skull bone 2, but damping in the bone cannot be avoided. Also some patients will experience frequent or chronic infection around the implant rendering this kind of treatment impossible for these patients.

Figure 3:
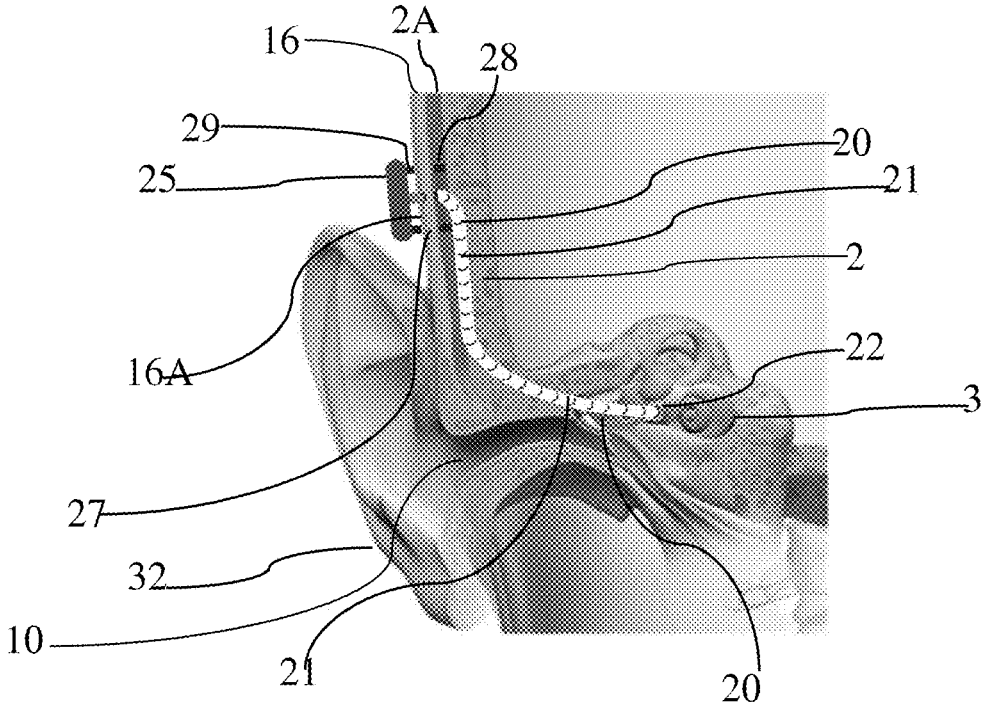
FIG. 3 shows a schematic section through a hearing device and an acoustical transmission means according to an embodiment of the invention.
Figure 3A:
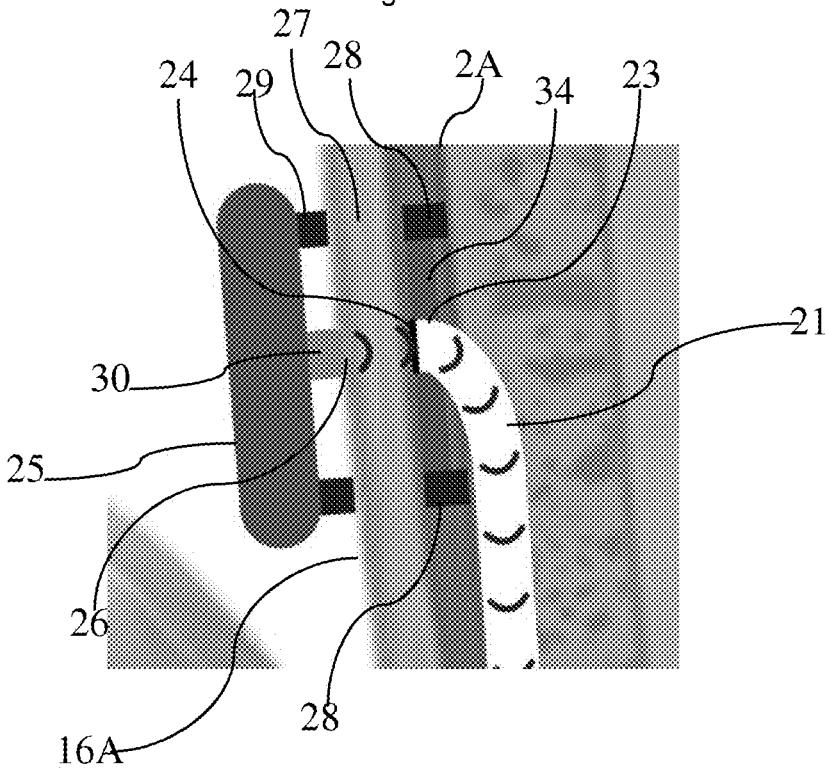
FIG. 3A is an enlarged view of a part of FIG. 3.

In FIG. 3, and the enlarged area view in FIG. 3A an example of an acoustical transmission means for transmission of acoustical energy to the cochlea is shown. In this device a liquid conduction means is shaped as a tube 20 defining a bore forming and acoustic conduct. A liquid or semi-liquid medium 21 is provided inside the bore and fill the bore. The tube 20 may be an implanted part, or may be shaped directly in the skull bone 2, and the medium 21 is chosen so as to be suitable for conducting acoustical energy there along. Possibly the medium is a gas or a liquid composition. Alternatively a semi liquid medium may be used. This could be a gel or a more coherent medium such as silicone or rubber. A liquid may be chosen which has acoustic properties such as acoustic impedance which is matched to the acoustic impedance of the perilymph inside the cochlea. The liquid filled tube 20 is terminated and in direct operative association with a window or aperture in the cochlea 3, for introducing acoustical energy there through. Acoustic input means 23 are also provided at the liquid conduction means 20. The acoustic input means 23 are adapted to be disposed subcutaneously between the skull bone surface 2A and an external skin surface 16A.

A transition area 24 which at a first side thereof abuts an underside of the skin 16 is provided at the transmission means and the transition area 24 abuts, at a second side thereof, the liquid or semi-liquid medium 21. The transition area defines the transition from skin tissue and to the transmission fluid or semi-fluid 21. If the medium is a silicone rubber or similar element, the transition area 24 may simply be constituted by the surface of this element abutting the underside of the skin. If the medium 21 is a fluid medium, a membrane 24 which acts to separate the medium from the tissue, will constitute the transition area 24. Such a membrane should ideally be flexible, especially at its rim, such that vibrational energy may be transmitted from the skin tissue and into the medium 21.

As seen in FIG. 3 and FIG. 3A, the acoustic transmission means is adapted to receive vibrations from a vibration generating transducer provided inside a casing 25. The transducer output abuts a transmission area 26 on an outer surface 16A of the skin 16 over the transition area 24. The transducer casing 25 may be magnetically attachable at a fastening area 27 which is adjacent to the transmission area.

In order to hold the transducer casing 25 in place an array of magnetic means 28 may be provided under the skin 16A in the fastening area 27 around the transition area 24. This array of magnetic means 28 interacts with corresponding magnetic means 29 at the transducer casing 25. The magnetic means 28 are provided at a bone surface 2A and may be fastened to this surface 2A by screws 42 (see FIG. 9) or by suture 43. Of the two set of magnetic means 28,29 the one magnetic means may comprise ferromagnetic parts, where the opposed means may comprise rare earth magnets or similar. Both arrays 28, 29 may also be made from rare earth magnets.

Figure 14:
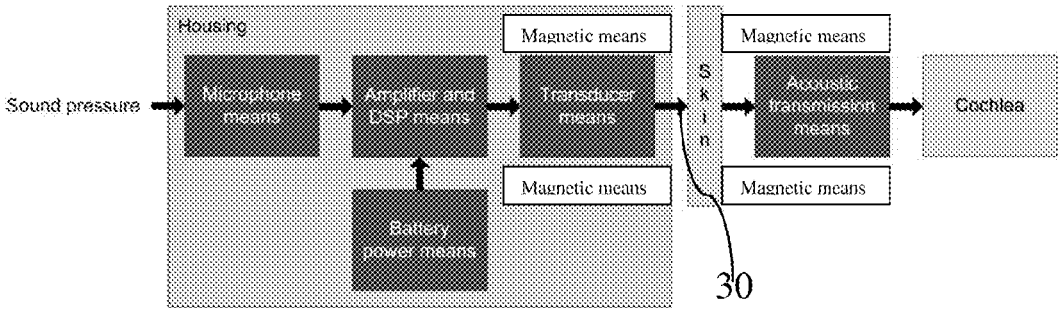
FIG. 14 shows a schematic representation of a listening device.

The transducer casing 25 as schematically illustrated in FIG. 14 comprises a casing labeled "housing" in FIG. 14 which contains a power source, such as a battery, a microphone, a signal processing device and output means. The output means (labeled "transducer means" in FIG. 14) performs the actual transducing of the electrical signal from the signal processing means and into mechanical vibrations of a skin abutting element 30. When the transducer casing 25 is attached by way of the magnetic means 28, 29 the skin abutting element 30 (see FIG. 3A) will abut the skin 16 which covers the intersection or transition area 24. The skin between the element 30 and the transition area 24 may be made thin as the load from the element 30 is small and further this load comprise a small DC component acting only to ensure contact between the skin surface and the transmission area 16. However, as the losses from the vibrator output at the transmission area and into the tube 20 are small, the thickness of the skin between the transmission area 24 and the skins surface 16A may remain the natural skin thickness of the patient at this point, if desired. The size of the transition area will be around the same size as the oval or round window on the cochlea, however the transition area is to be dimensioned according to the chosen vibration transducer.

Figure 4:
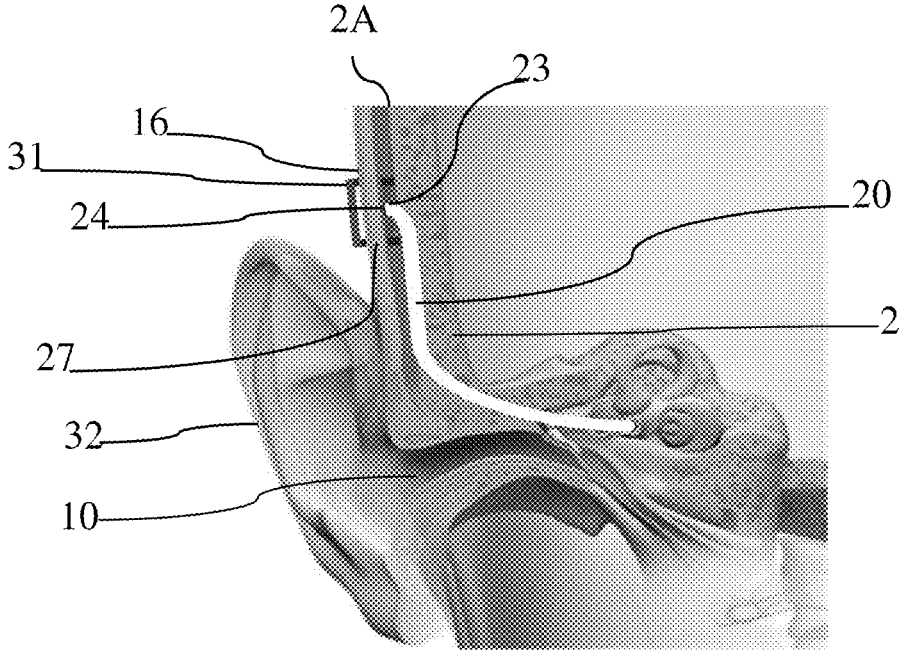
FIG. 4 shows a schematic section through the transmission path and a protective cap.

In FIG. 4 a protection cap 31 is shown which is adapted to be magnetically attached above and/or around the transition area 24. Such a protection cap 31 is usable at times when the transducer casing 25 is not in place, such as during sleep, showering, grooming and other activities, where the transducer casing 25 would be a bother and possibly in the way for the user. When the protection cap 31 is in place, the central parts thereof will be close to the skin 16 above the transition area, but not in touch with the skin. Nothing will then be able to touch the skin above the transition area 24. A weaker magnetic force between the protection cap and the underlying magnets may be foreseen, as the cap weights less than the transducer. Preferably the cap is kept as flat as possible in order to not be in the way of the wearer during activities. As seen in FIG. 4 the cap 31 has nicely rounded edged to avoid that it gets hooked to clothes and the like.

Figure 9:
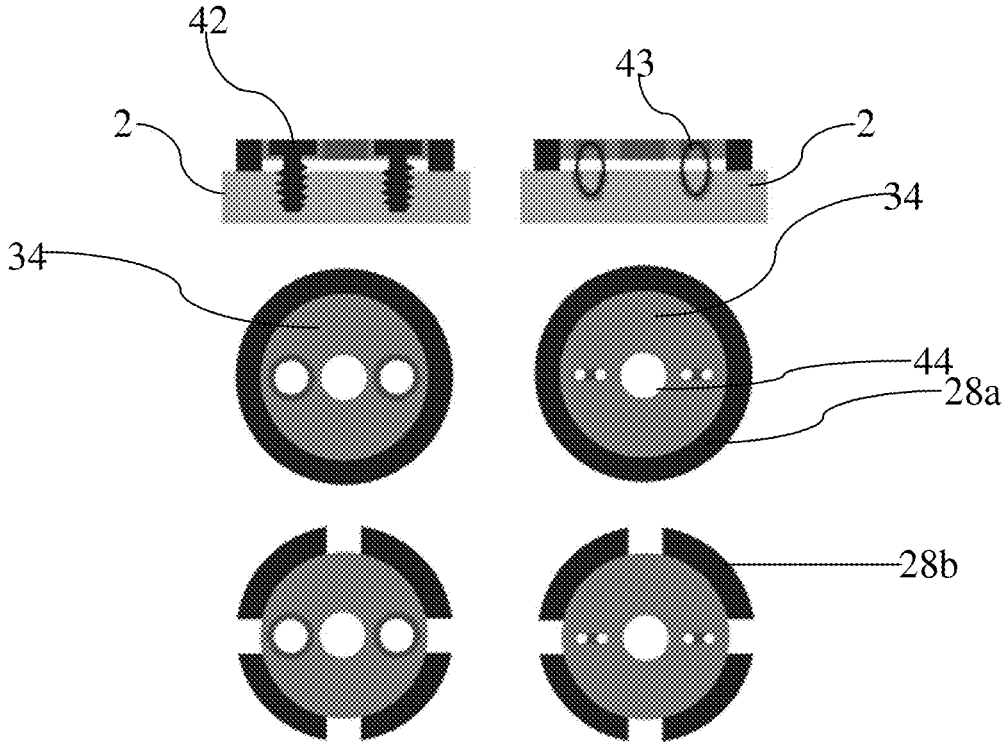
FIG. 9 shows a schematic representation of fastening means and arrangements of arrays of magnets in the subcutaneous part.

FIG. 9 discloses how the tube 20 is seated in a holder plate 34. A hole 44 is provided centrally in the plate 34, and the tube 20 pass through the hole 44. The plate 34 may be fastened in the bone tissue 2 by means of screws 42 as seen in the left hand side of FIG. 9 or by means of sutures 43 as seen in the right hand side of FIG. 9. As also seen in FIG. 9 the magnetic means associated with the plate 34 may comprise a ring magnet 28*a*, or alternatively segmented magnetic means 28*b*. With segmented magnetic means blood can better flow in and out of the area in the center of the magnet. Any number of segments may be used. The advantage of a ring magnet is that it will provide a higher attachment force with the same overall area of the attachment site.

Figure 5:
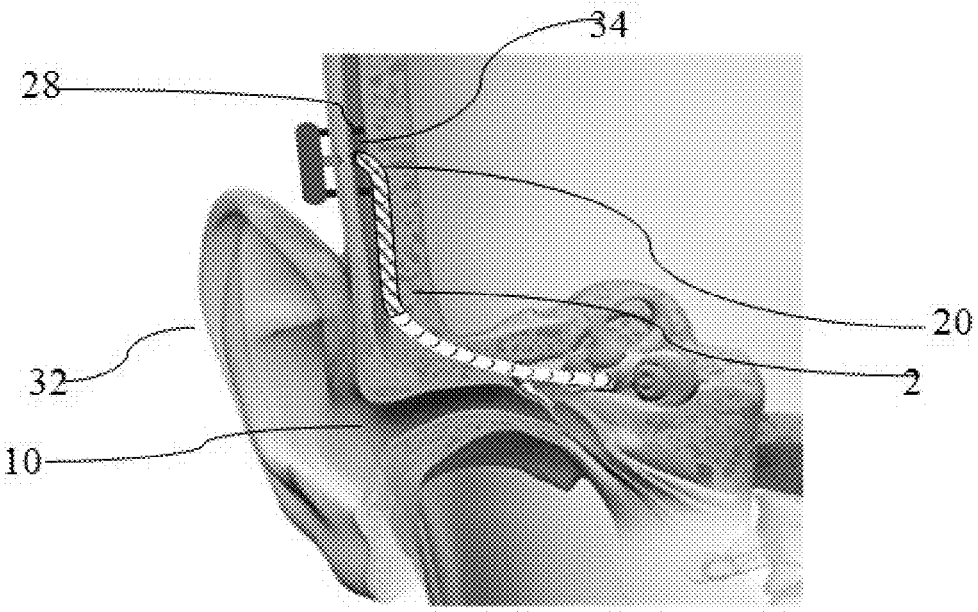
FIG. 5 shows a schematic section through a transmission means.

As seen in FIGS. 3, 4 and 5, the bore or tube 20 with the liquid conducting means 21 may be provided along an outer surface part 2A of the skull bone 2 in the area from the transition area 24 and to a position adjacent to the ear canal 10. Thereby shaping of a canal for this tube may easily be performed in the exterior skull bone and will not compromise the safety of the patient's brain tissue. The first part of the wave guide or tube 20 does not have to run through a drilled hole but rather in a groove on the outside of the skull bone. This could simplify surgery. The groove should be deep enough so that the waveguide is not exposed to accidental touching. The part that could be in a groove is marked with hatching in FIG. 5.

Figure 6:
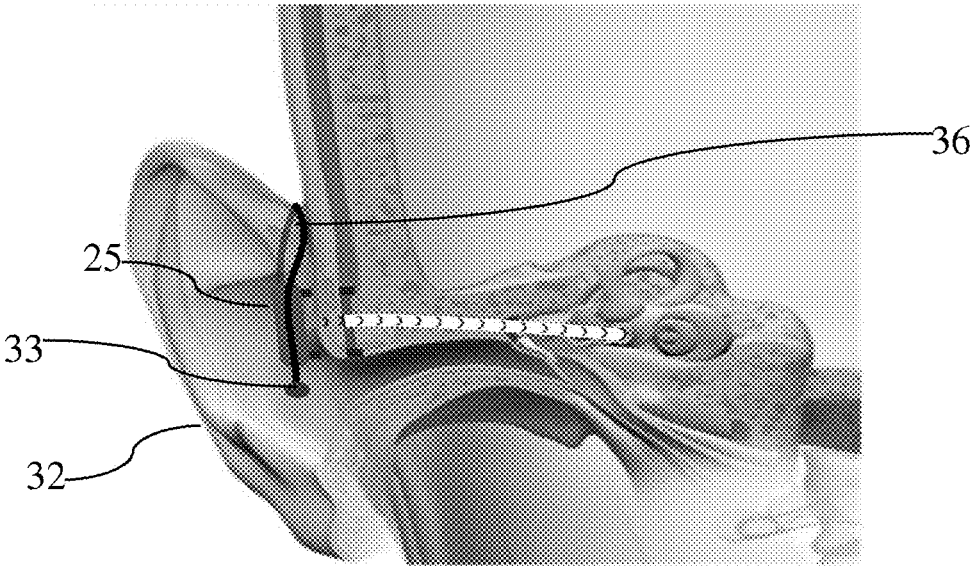
FIG. 6 shows a schematic section through an ear, whereby the transmission means runs from behind the ear to the cochlea.
Figure 7:
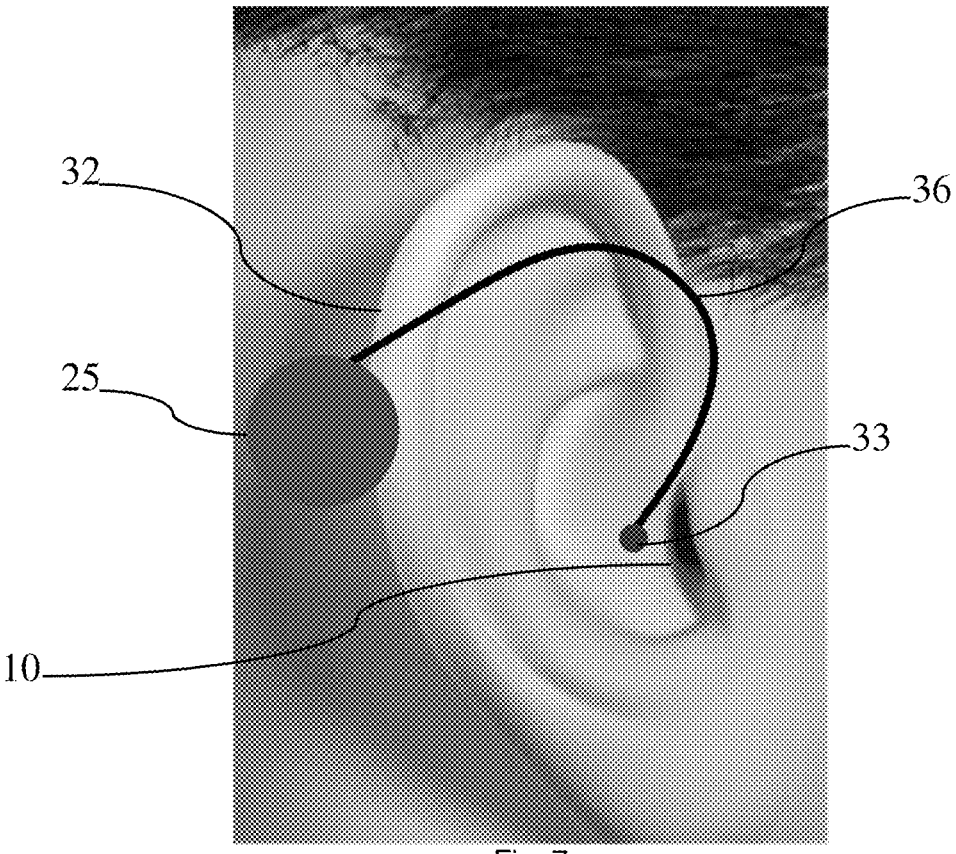
FIG. 7 shows a side view from outside of a hearing aid to be used with the transmission means shown in FIG. 6.

As seen in FIGS. 6 and 7 the transition area 24 may be provided adjacent the ear canal but behind the outer ear 32, and a microphone 33 is provided and positioned at the entrance of the ear canal 10. In FIG. 6 a vertical section through the ear canal seen from the front is disclosed, and the outer ear is shown with some degree of transparency, whereby the transducer casing 25 is seen through the ear. The microphone 33 is connected to the transducer through signal transmission and processing means inside the casing 25. A lead 36 which serves both positioning and signal transfer tasks is also seen, which connects the transducer casing 25 with the microphone 33. This placement of the transition area ensures that only minimal bending are provided in the transmission tube, and this ensures an efficient and low loss transmission of the acoustic energy. Further, the placement of the transmission area behind the outer ear, may aid in protecting the transmission area against accidental touching, which could cause discomfort for the user. The alternative microphone placement will take advantage of the directionality that the outer ear contributes to. Also, feedback may be reduced by moving the microphones away from the vibrator/transducer. In FIG. 7 the lead 36 is shown in front of the ear, but in reality they will be provided close to the skin behind the ear of the user.

Figure 8:
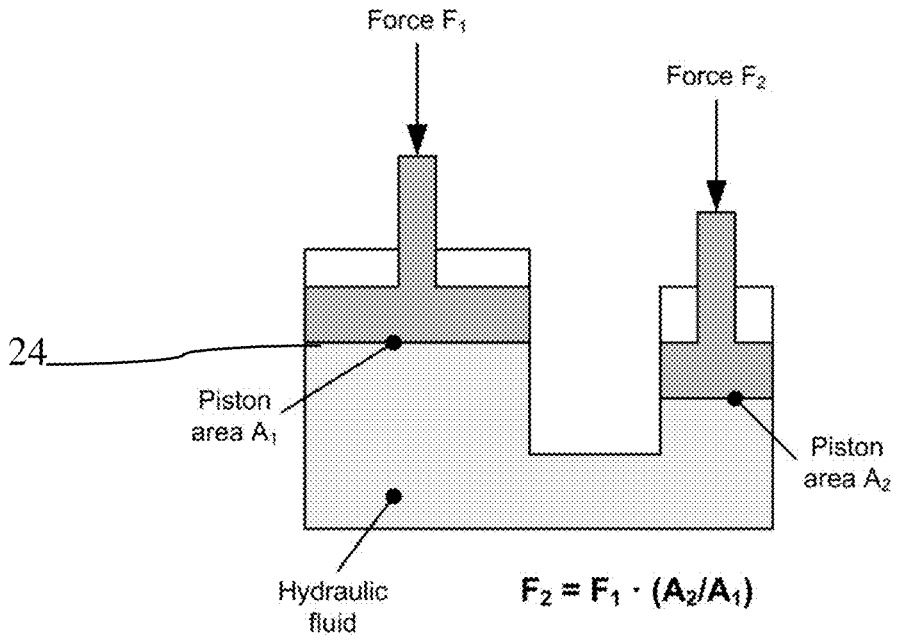
FIG. 8 shows schematic representation of the force balance between input and output side of the transmission means.

In FIG. 8 a schematic view of the hydraulic acoustic transmission system is provided, and here the transition area 24 which could be equivalent to the piston area $A_1$ is shown as larger than the area of the contact area on the cochlea $A_2$, which terminates the liquid conduction means. Because of this area difference, the force $F_2$ provided to the cochlea is smaller than the force $F_1$ provided at the transition area 24, and provided that a non-compressible fluid is used, the amplitude will be larger. The mathematic expressing this force balance is simple: $F_2=F_1\cdot(A_2/A_1)$. This arrangement allows some degree of design freedom for choosing the areas and input force, in order to arrive at the required driving force on the cochlea input site. Each of the areas $A_2$ and $A_1$ may be considered as the input side.

If the vibrator technology allows a large force but small displacement compared to what is needed in the cochlea, the tube area at the skin could be made bigger than the area at the cochlea.

On the other hand, if the vibrator technology allows a large displacement but small force compared to what is needed in the cochlea, the tube area at the skin could be made smaller than the area at the cochlea.

In order to match the implanted array of magnets 23 the transducer casing 25 comprise individual magnetic means 29 opposite the magnetic means 28 around the transition area 24.

With reference to FIG. 14 it is explained how the listening device works. When the listening device is working a microphone means adapted to receive sounds will capture sounds and transform the sound signal into an electrical signal and provide this electric signal to a signal processing means labeled "Amplifier and DSP means". The amplifier and DSP means is adapted to receive this electric signal and provide an enhanced electric signal based on the microphone signal and the user's needs. The enhanced electrical signal is then served at a transducer means and this transducer means comprise an output surface 30 which is adapted to vibrate according to the enhanced signal. In order to attach the transducer to a predefined skin portion, labeled "SKIN", magnetic means are arranged externally co-jointly with the transducer and internally under a skin portion, circumferentially with respect to said output surface 30 of the transducer.

In this way the output surface 30 is an outer surface of an externally mounted device, and the output surface 30 and the magnets are arranged next to each other such as to abut a mutual plane facing away from the device. In order to ensure constant contact between the transducer and the outer skin surface, possibly the transducer output side may protrude somewhat forward of the external magnets as indicated in FIG. 14. Through the magnets abutting this plane and the corresponding implanted magnets, the device may attach to a skin portion of the user, and the vibrational signal input surface may be arranged next to the surface skin part where under the magnetic means are provided.

Figure 14A:
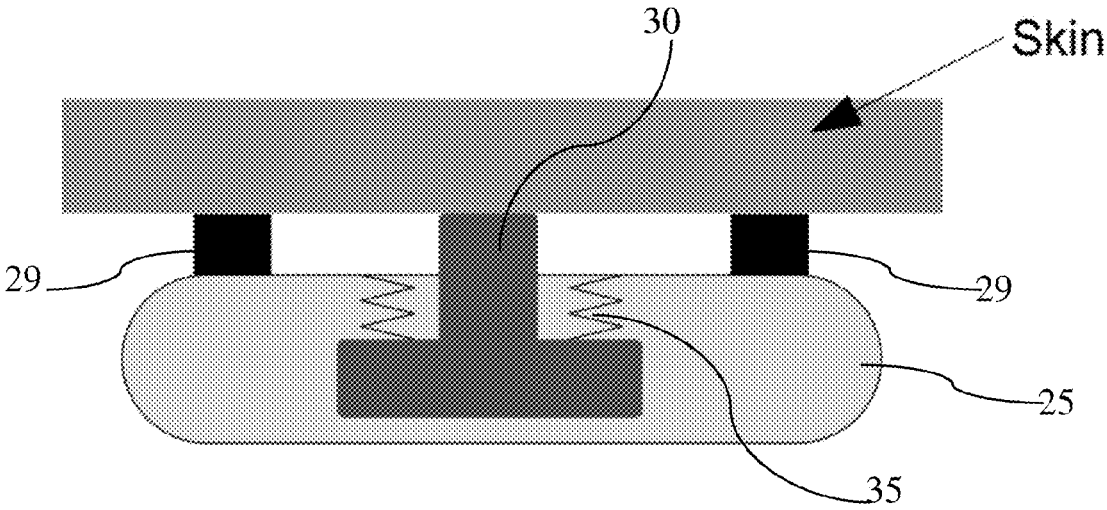
FIGS. 14A and 14B shows an enlarged schematic view of the interface between skin and transducer casing.
Figure 14B:
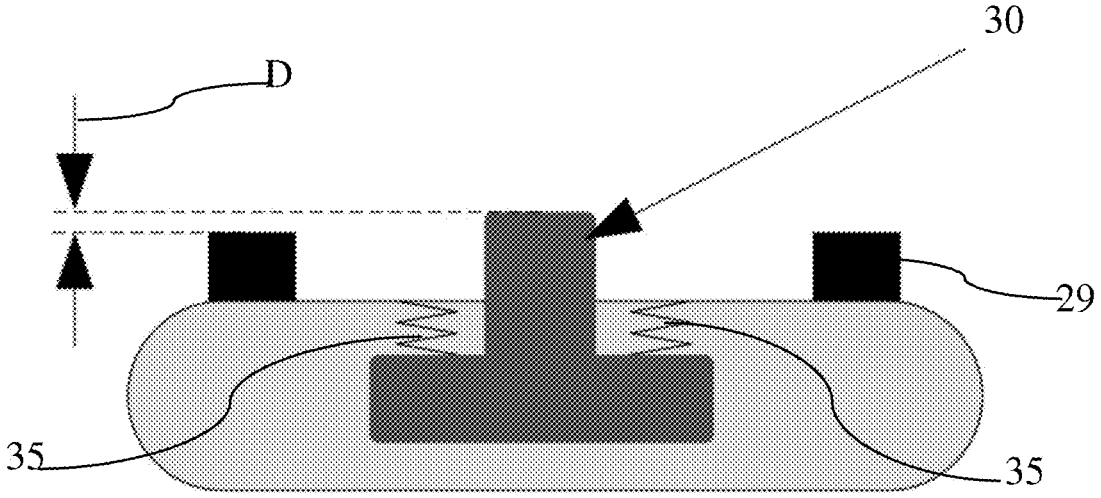

FIGS. 14A and 14B shows an enlarged schematic view of the interface between skin and transducer casing 25. As seen the magnets 29 protrudes from the transducer casing 25 as does the output surface 30, however the vibrator is urged towards the skin surface by means of springs 35. In FIG. 14B the device is seen when not attached to the users skin, and here the springs 35 have urged the transducer means and its output surface 30 a distance D forward with respect to the magnets 29 in the direction of attachment. This ensures good contact between the output surface 30 and the skin whenever the transducer casing 25 is attached to the skin by virtue of the internal magnetic means 28 and external magnetic means 29.

The vibrational signal which is delivered by the output transducer is transmitted through the skin and through a subcutaneous transition area and into a fluid or semi-fluid conduct. When the signal is transported along the conduct, this may take place with very little loss due to the impedance mis-match between the fluid in the conduct and rather hard internal surfaces of the conduct walls and the signal may reach the cochlea virtually without loss. At the cochlea, an impedance matching means may be provided if required in order to feed the signal into the fluid of the cochlea. The impedance matching means may comprise a simple membrane, or the like at the end of the conduct. Also a number of membranes may be provided and stacked flat against the end or inside the conduct to gradually change the impedance towards a final transition into the cochlea fluid.

In an embodiment of the invention, a further safety feature may be introduced on order to leave the cochlea less vulnerable to trauma. An accidental blow to the wave guide underneath the skin could cause damage to the cochlea. To avoid this, a pressure relief zone on the wave guide is proposed. Somewhere on the wave guide there thus may be a segment that, for a predefined pressure, expands and thereby lowers the pressure that reaches the cochlea. This is further described in FIGS. 10 through 13.

Figure 10:
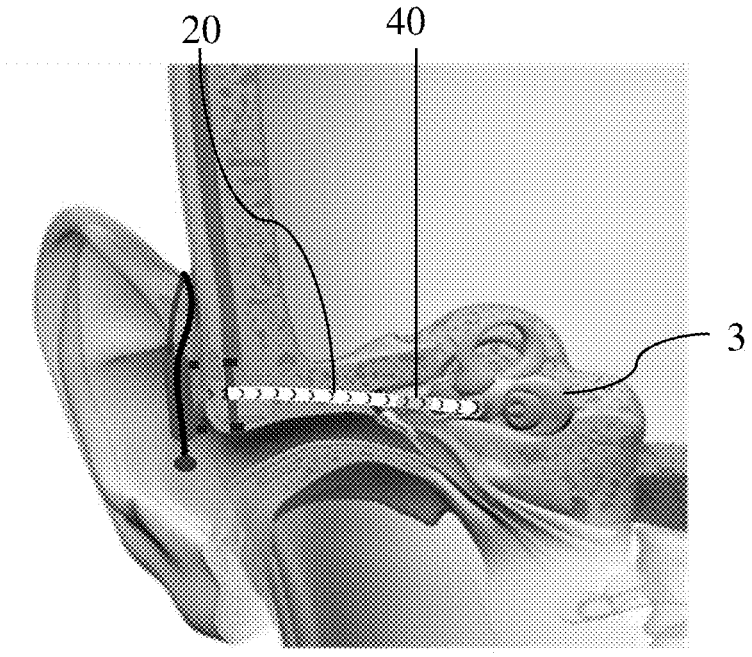
FIG. 10 shows a schematic embodiment of the invention.

In FIG. 10 the liquid conducting means 20 with pressure relief zone 40 is indicated. It is situated next to the cochlea 3 within the middle ear, where some space may be available and where it may also be surrounded by air, such that expansion of the part is possible without encountering bone or other hard tissue.

Figure 11:
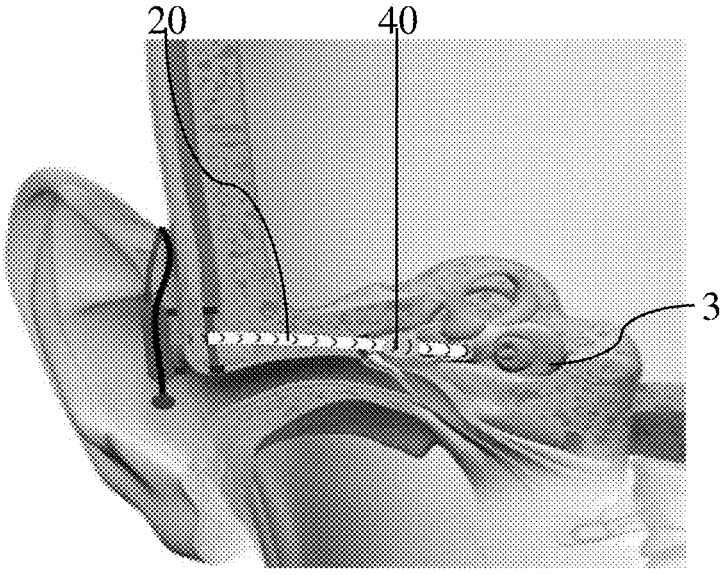
FIG. 11 shows a schematic view of the embodiment in FIG. 10, but in a different situation.

In FIG. 11 the pressure relief zone 40 is shown in expanded form. This is what would happen if the sound pressure inside the wave guide were to reach potentially harmful levels. In this shape the pressure relief zone works as a damper zone which absorbs high sound pressures and ensures that they do not reach the cochlea 3.

Figure 12:
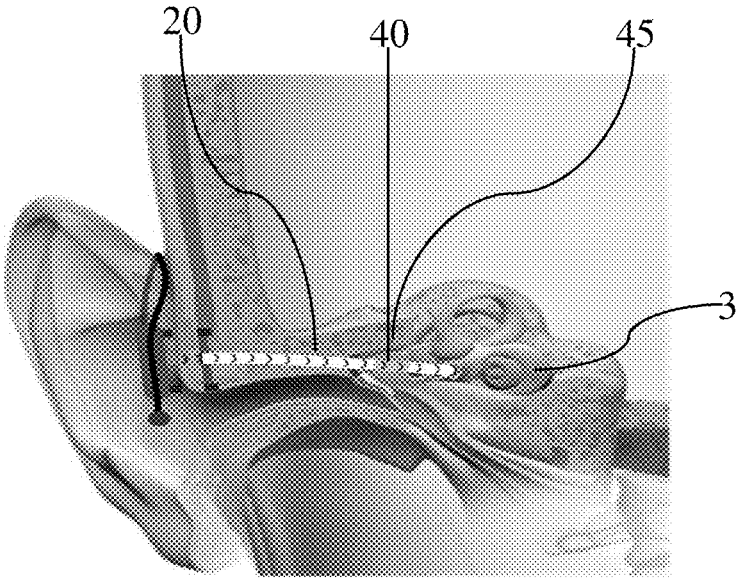
FIG. 12 shows a schematic view of a further embodiment.
Figure 13:
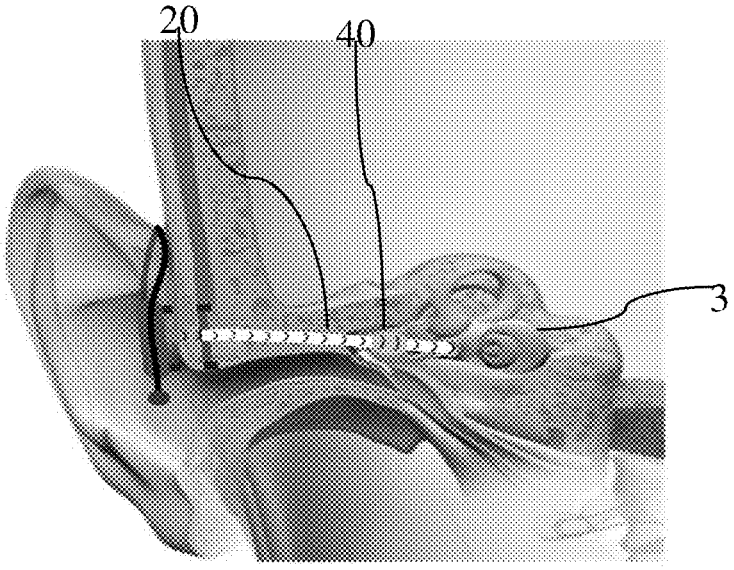
FIG. 13 shows the embodiment of FIG. 12 in a different situation.

In FIG. 12 a wave guide is shown with pressure relief zone 40 encapsulated in a cavity of a compressible gas/liquid/material 45. In this way, the outer dimensions of the waveguide would not change even if a high pressure should cause the pressure relief zone to expand, and in FIG. 13 this is illustrated by showing the pressure relief zone 40 expanded inside the cavity 45.

Preferably the pressure relief zone does not expand at all until the dangerous sound pressure is reached. But at that pressure it expands very rapidly, lowering the pressure in the wave guide. In this way the effectiveness of the acoustic transmission during normal operation (harmless sound pressure levels) would not be affected. The pressure relief zone could be provided at any of the mentioned embodiments in this description.

Preferred embodiments are defined in the dependent claims. Any reference numerals in the claims are intended to be non-limiting for their scope.

For conventional bone conduction hearing aids one big problem is feedback due to sound waves radiating from the skull, through the skin and through the air into the microphones of the hearing device. This limits the amount of gain that can be used in the hearing device. Since the vibrations of the skull using this method is greatly reduced, this feedback problem should also be a much less significant issue.

Since no wireless link is needed, the energy loss associated with wireless energy being transmitted through a skin layer is avoided. Also, the risk for electromagnetic interference is avoided. And further microphones, amplifier and vibrator are all easily upgradeable/repaired since they are placed outside the body. I.e. all active components are outside the body Some preferred embodiments have been shown in the foregoing, but it should be stressed that the invention is not limited to these, but may be embodied in other ways within the subject-matter defined in the following claims. Naturally individual adaptations according to the patient's anatomy may be made, and the transducer may be placed at virtually any location on the skull.

The invention claimed is:

1. An acoustic transmission device for transmission of acoustical energy to a cochlea, the device comprising:

a liquid conducting assembly including a tube defining a bore through the tube, and a liquid or semi-liquid medium filling said bore, for conducting the acoustical energy along the bore, said liquid conducting assembly terminated at, and adapted to be disposed in direct operative association with, the cochlea, for introducing said acoustical energy to the cochlea;

an acoustic input unit at said liquid conducting assembly, wherein said acoustic input unit is adapted to be disposed subcutaneously between a surface of a skull bone and an external surface of skin and includes a transition area which is adapted at a first side of the transition area to abut an underside of the skin and at a second side of the transition area to abut the liquid or semi-liquid medium filling said bore;

a vibration generating transducer adapted to abut a transmission area on an outer surface of the skin over the transition area, the vibration generating transducer being magnetically attachable at a fastening area adjacent to the transmission area; and a magnetic assembly configured to be provided under the skin in the fastening area around the transition area to provide a magnetic attachment of the vibration generating transducer.

2. The acoustic transmission device as claimed in claim 1, further comprising:

a protection cap adapted to be magnetically attached at least above or around the transition area.

3. The acoustic transmission device as claimed in claim 2, wherein the transition area includes a membrane between the liquid conducting assembly and the skin, and the membrane at a perimeter or rim portion of the membrane is sealed against the tube or against a rim of a hole in a fastening plate.

4. The acoustic transmission device as claimed in claim 3, wherein at least one of the fastening plate, the magnetic assembly, and the liquid conducting assembly is configured to be fastened to the skull bone by a suture.

5. The acoustic transmission device as claimed in claim 3, wherein the bore with the liquid or semi-liquid medium is configured to extend along an outer surface part of the skull bone from the transition area to a position adjacent to an ear canal.

6. The acoustic transmission device as claimed in claim 1, wherein the transition area of the acoustic input unit is configured to be positioned adjacent an ear canal but behind an outer ear, and a microphone is configured to be positioned at an entrance of the ear canal and is connected to the vibration generating transducer through a signal transmission and processing device.

7. The acoustic transmission device as claimed in claim 1, wherein the magnetic assembly includes an array of individual magnets disposed around a membrane leaving space between the individual magnets.

8. The acoustic transmission device as claimed in claim 1, wherein the vibration generating transducer is disposed in a casing, said casing holding a magnetic coupler opposite the magnetic assembly around the transition area.

9. A listening device, comprising:

a microphone adapted to receive a sound and provide an electric signal in accordance with the sound;

a signal processor adapted to receive said electric signal and provide an enhanced electric signal and adapted to serve the enhanced electric signal at a transducer;

the transducer, wherein the transducer includes an output surface adapted to vibrate according to said enhanced electric signal and a magnetic coupler arranged circumferentially with respect to said output surface; and an acoustic transmission device, including a liquid conducting assembly including a tube defining a bore through the tube, and a liquid or semi-liquid medium filling said bore, for conducting acoustical energy along the bore, said liquid conducting assembly terminated at, and adapted to be disposed in direct operative association with, the cochlea, for introducing said acoustical energy to the cochlea;

an acoustic input unit at said liquid conducting assembly, wherein said acoustic input unit is adapted to be disposed subcutaneously between a surface of a skull bone and an external surface of skin and includes a transition area which is adapted at a first side of the transition area to abut an underside of the skin and at a second side of the transition area to abut the liquid or semi-liquid medium filling said bore; and a magnetic assembly configured to be provided under the skin in a fastening area around the transition area to provide a magnetic attachment of the transducer, wherein the transducer is adapted to abut a transmission area on an outer surface of the skin over the transition area, the transducer being magnetically attachable at the fastening area adjacent to the transmission area by the magnetic coupler interacting with the magnetic assembly.

10. The listening device as claimed in claim 9, wherein the output surface of the transducer is an outer surface, and wherein the output surface and the magnetic coupler are arranged side by side such that the transducer output surface protrudes forward with respect to the magnetic coupler in a direction of attachment and facing away from the listening device.

11. The listening device according to claim 9, wherein the magnetic coupler includes an array of discrete magnets arranged circumferentially with respect to the output surface of the transducer.

12. A method for transmitting a sound signal to a cochlea, comprising:

attaching a transducer at an external surface of a user's skin, the transducer including an output surface adapted to vibrate according to an input signal, and a magnetic coupler arranged circumferentially around said output surface;

capturing the sound signal by a microphone;

transmitting the captured sound signal as an electrical audio signal to a signal processing device;

processing the electrical audio signal in the signal processing device and serving a resulting enhanced electrical signal at the transducer, said transducer being adapted to transmit a vibrational signal to the external surface of the user's skin based on the enhanced electrical signal;

transmitting said vibrational signal by the transducer through the user's skin and through a subcutaneous transition area into a fluid or semi-fluid conducting assembly, said fluid or semi-fluid conducting assembly including an acoustic input unit adapted to be disposed subcutaneously between a surface of a skull bone and the external surface of the user's skin and including the subcutaneous transition area which is adapted at a first side to abut an underside of the user's skin and at a second side to abut a liquid or semi-liquid medium filling a bore of a tube, and the tube defining the bore through the tube, filled with the liquid or semi-liquid medium for conducting acoustical energy along the bore, said fluid or semi-fluid conducting assembly terminated at, and adapted to be disposed in direct operative association with, the cochlea, for introducing said acoustical energy to the cochlea;

transmitting said vibrational signal through said fluid or semi-fluid conducting assembly to the cochlea; and transmitting said sound signal into the cochlea, wherein the transducer is held at the external surface of the user's skin by interaction between the magnetic coupler and a magnetic assembly configured to be provided under the skin in a fastening area adjacent to a transmission area on the external surface of the user's skin over the subcutaneous transition area to provide a magnetic attachment of the transducer.

* * * * *